US007757922B2

(12) United States Patent
Wang

(10) Patent No.: US 7,757,922 B2
(45) Date of Patent: Jul. 20, 2010

(54) POWER BEATING DEVICE

(75) Inventor: Feng-Ho Wang, Hsinchu (TW)

(73) Assignee: Jelley Technology Co., Ltd, East District, Hsinchu (TW)

( * ) Notice: Subject to any disclaimer, the term of this patent is extended or adjusted under 35 U.S.C. 154(b) by 137 days.

(21) Appl. No.: 12/025,725

(22) Filed: Feb. 4, 2008

(65) Prior Publication Data

US 2009/0194576 A1 Aug. 6, 2009

(51) Int. Cl.
*B25C 1/00* (2006.01)

(52) U.S. Cl. ..... 227/132; 227/131; 227/110; 227/129; 227/133

(58) Field of Classification Search ..... 227/131, 227/110, 129, 132, 133, 134; 173/101, 102, 173/118, 202, 203, 120, 122, 205
See application file for complete search history.

(56) References Cited

U.S. PATENT DOCUMENTS 3,826,316 A * 7/1974 Bassinger ..... 173/73
3,924,692 A * 12/1975 Saari ..... 173/117
4,284,148 A * 8/1981 Wanner et al. ..... 173/109
4,289,041 A * 9/1981 Valdespino ..... 74/56
4,384,622 A * 5/1983 Koziniak ..... 173/205
4,572,419 A * 2/1986 Klaus et al. ..... 227/8
4,592,502 A * 6/1986 Judge ..... 227/131
4,744,423 A * 5/1988 Chia-Hsi ..... 173/90
4,807,793 A * 2/1989 Ghibely ..... 227/131
4,811,885 A * 3/1989 Lai ..... 227/131
4,953,774 A * 9/1990 Lai ..... 227/131
4,984,640 A * 1/1991 Gillan et al. ..... 173/205
5,794,325 A * 8/1998 Fallandy ..... 29/566.4
5,836,403 A * 11/1998 Putney et al. ..... 173/205
6,199,640 B1 * 3/2001 Hecht ..... 173/48
6,604,666 B1 * 8/2003 Pedicini et al. ..... 227/131
6,733,414 B2 * 5/2004 Elger ..... 475/331
6,785,950 B1 * 9/2004 Scirbona et al. ..... 29/566.4
6,971,567 B1 * 12/2005 Cannaliato et al. ..... 227/2
7,152,774 B2 * 12/2006 Chen ..... 227/131
2004/0232194 A1 * 11/2004 Pedicini et al. ..... 227/131
2006/0144603 A1 * 7/2006 Arich et al. ..... 173/109
2009/0193915 A1 * 8/2009 Wang ..... 74/89.23

* cited by examiner

*Primary Examiner*—Brian D Nash

(57) ABSTRACT

A power beating device using includes a driving unit and an actuator. The driving unit has a spring for storing and releasing energy so as to drive an impact unit. The driving unit has at least one driving surface. The actuator serves for actuating the driving surface so that the impact unit is lifted with the driving unit. Deformation of the spring will store energy. When the impact unit is lifted to a predetermined height, it will rest and then the spring will release energy to drive the impact unit to have the effect of beating.

2 Claims, 9 Drawing Sheets

POWER BEATING DEVICE

FIELD OF THE INVENTION

The present invention relates to a power beating device, and particularly to a power beating device used in a nail or staple driver, which has a set of driving unit containing a spring as an energy storage and releasing devices for driving an impact unit.

BACKGROUND OF THE INVENTION

Generally, a power beating device uses a driving unit, such as a liner movement of an electromagnet or a simple harmonic motion from the rotation movement of a motor, to resist against an energy storage unit, for example to use a spring to cause an impact unit to move from a first position to a second position so as to store the potential energy from electric energy. When the spring moves to a second position, the storage energy is converted into the dynamic energy of the impact unit so as to drive a nail into a work piece. The requirement of this kind of power beating device is that it must be light and power saved. However the defects of the electromagnetic driving are heavy and power consumed, while the simple harmonic motion from the rotation movement of a motor is that the power is unstable, especially when the impact unit moves to an impact position driving the nail, the spring needs a great driving force, but at this moment, the simple harmonic motion from the rotation movement of a motor is at a maximum value in the sinusoidal moving curve. To compensate this defect, in U.S. Pat. No. 4,811,885 A1, in the simple harmonic motion from the rotation movement of a motor, a flywheel is added for providing a greater pushing force to the spring as the spring moves to a distal end for driving the impact unit to beat the nail. However the flywheel consumes more power and is uneconomic.

In U.S. Pat. No. 4,953,774, another power beating device is disclosed, in that in the simple harmonic motion from the rotation movement of a motor, the spring has different pitches so as to improve the phase deficiency in the simple harmonic motion from the rotation movement of a motor. Furthermore, a cam unit is provided. The cam unit can reset the impact unit as in the distal end, the driving force is insufficient so that the impact unit is buckled in a dead point, while the power nail driver is power off. However all these devices will make the device complicated and can not improve the prior art defect effective.

SUMMARY OF THE INVENTION

In the present invention, an inclined plane principle is used for improving power efficiency and reduce the weight is disclosed. A power beating device using an inclined plane comprises: a driving unit has a spring for storing and releasing energy so as to drive an impact unit; wherein the driving unit has at least one driving surface; an actuator serves to actuate the driving surface so that the impact unit is lifted with the driving unit, and the spring deform to store energy; when the impact unit is lifted to a predetermined height, it will rest and then the spring will release energy to drive the impact unit 40 to have the effect of beating. Thus the prior linear driving by using electromagnet or the rotation driving by using motor to convert into simple harmonic reciprocating motion are improved by the present invention so that it can resist against the energy storage unit instead of an operation by an inefficiency energy storage process.

Another object is to use a proper height h and an elastic coefficient k to control an output torque of a motor so that the output torque of the motor is retained with a constant value and meanwhile, the rotation speed, current, and output torque of a motor is controllable. Thus the rated power of the motor is reduced and thus the sizes of the motor and battery are also reduced. Further, the height h and the elastic coefficient k are designed to improve the efficiency of the motor and save power.

To achieve about object, the present invention provides a power beating device which is installed with a driving unit. The driving unit 2 is a round cylinder which is driven by an actuator 30. A driving surface 11 of the driving rotary cylinder 10 is an helical surface. The helical angle θ thereof is varied with a height h. The height is increased in the rotation direction. When the height achieves to a maximum displacement of a spring, then the height is reset. When the driving unit 2 moves, an impact unit 40 is lifted with the driving surface 11 of the driving unit 2. The spring 20 also stores energy. The increment of the driving surface 11 of the driving unit 2 is designed to make the driving resisting force in the energy storage process is wholly controlled manually. That is to say, the user can control the power supply curve of a motor. For example, the height of the driving surface 11 of the driving unit 2 is designed properly so that the time variation of the increment of the height ($\Delta h/\Delta t$) is increased with the resistance force (f) of the displacement ($\Delta s$) of the spring 20, and then the output torque of the motor is retained to a constant value. Furthermore, the rotation speed, current, output torque, and efficient of the motor is controllable. Thus the rated power of the motor is reduced and thus the sizes of the motor and battery are also reduced. Further, the height h and the elastic coefficient k are designed to improve the efficiency of the motor and save power.

Moreover, in the present invention, the driving unit 2 is a wedge driving block which is driven by an actuator 30, the driving surface 11 of the driving block has an inclined plane and the driving unit 2 has at least one driving surface 11; there is at least one impact unit 40; a height of the impact unit 40 is increased with the displacement of the impact unit 40; the displacement of the impact unit 40 is a teethed shape so as to cause the spring 20 has a maximum displacement and then the height is reset.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
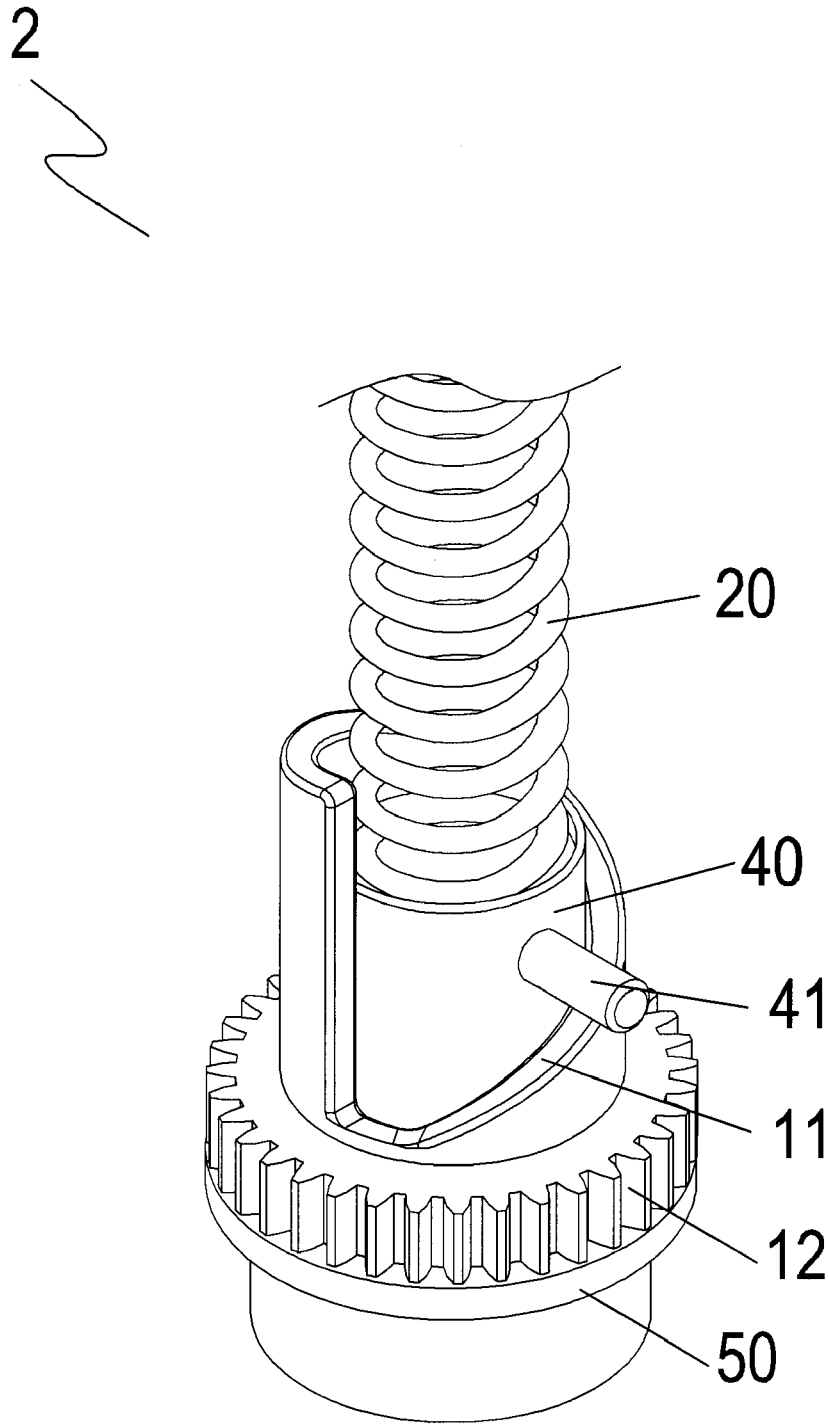
FIG. 1 is a schematic perspective view of one preferred embodiment of the power beating device of the present invention.
Figure 2:
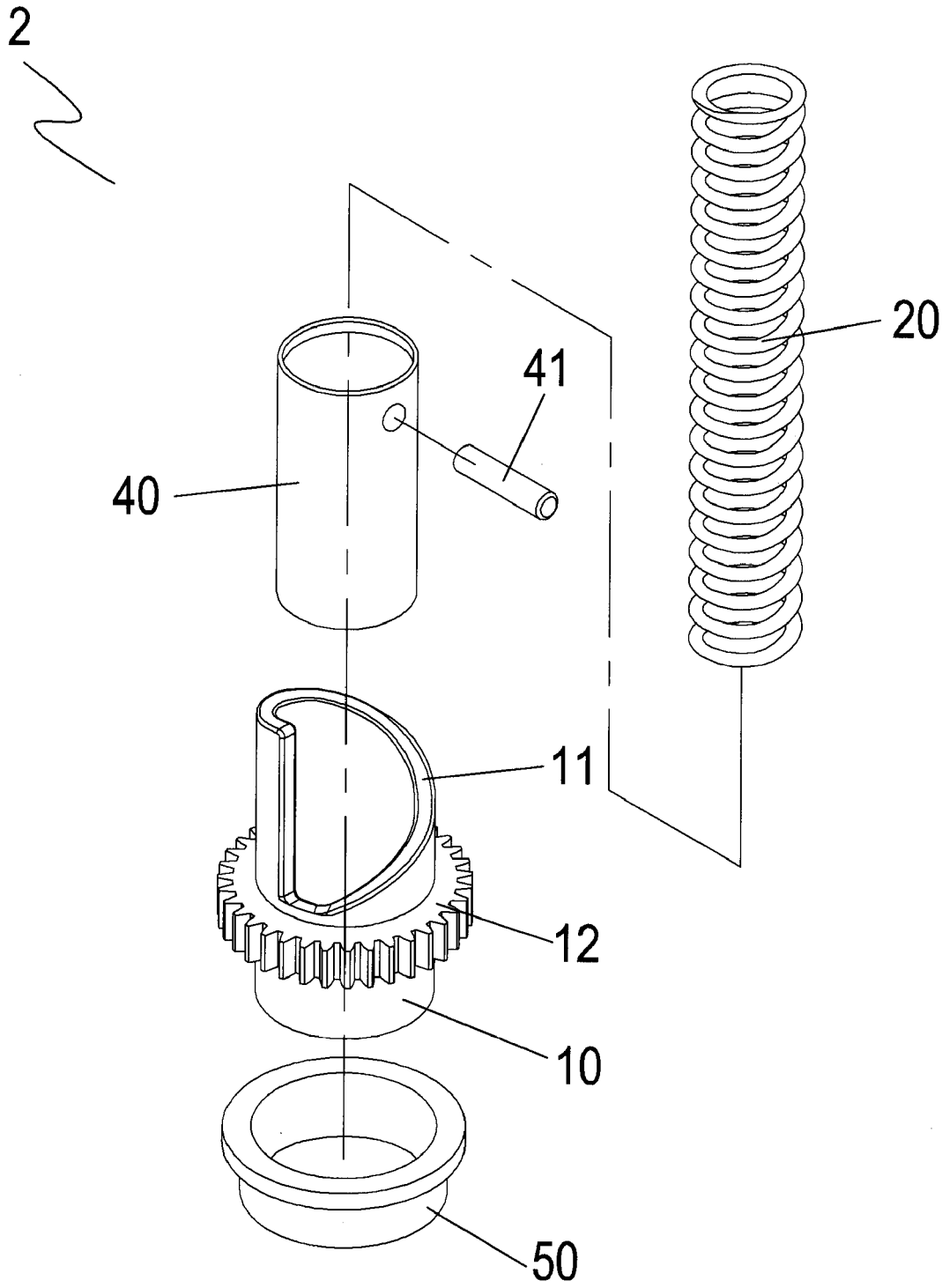
FIG. 2 an explosive schematic view about the preferred embodiment of the power beating device of the present invention.

With referring to FIGS. 1 and 2, the power beating device of the present invention includes the following elements.

A set of driving unit 2 has a spring 20 for storing and releasing energy, an impact unit 40, a driving rotary cylinder 10 and a driving bush 50. The spring 20 drives an impact unit 40. The driving pin 41 inserts into the impact unit 40. The driving rotary cylinder 10 has a driven gear 12 at an outer periphery thereof and a wedge helical driving surface 11 above the driven gear 12. The driving bush 50 is installed at a lower side of the driving rotary cylinder 10. The driven gear 12 is driven to rotate in the driving bush 50. In assembly, the spring 20 is received in the impact unit 40 and then the impact unit 40 is received in the wedge helical driving surface 11.

Figure 3:
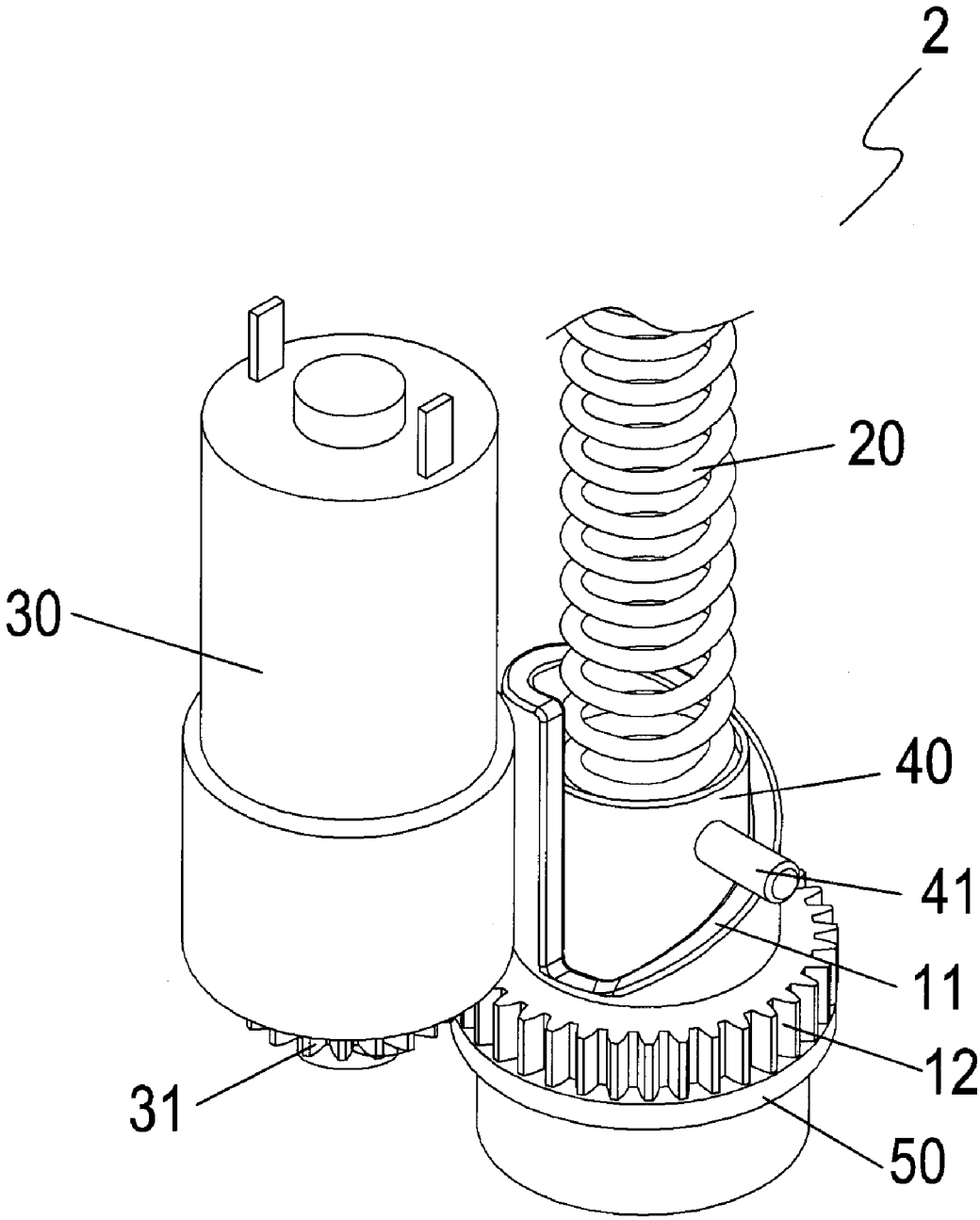
FIG. 3 is a lateral view of a preferred embodiment of the power beating device of the present invention.
Figure 4:
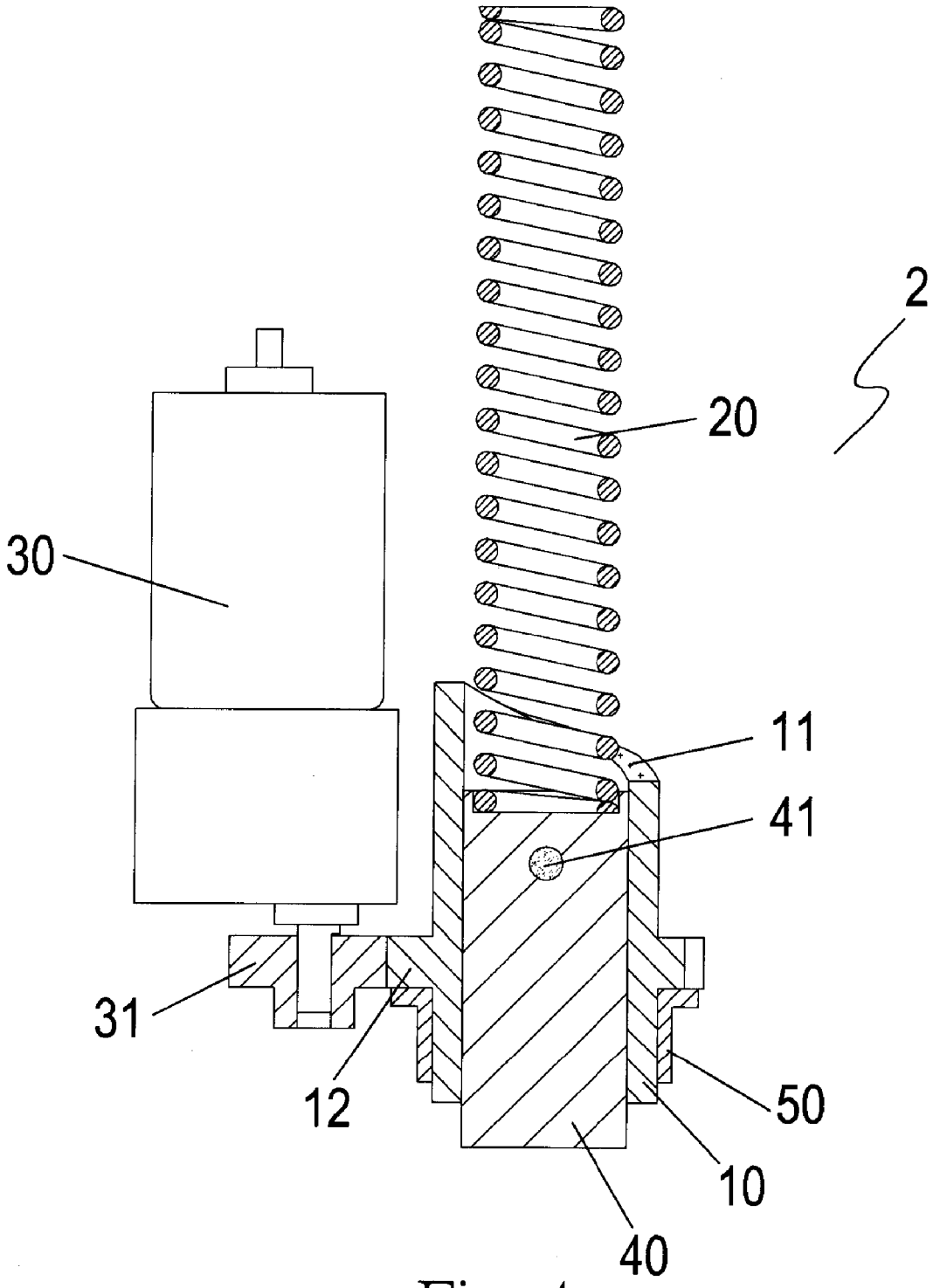
FIG. 4 is a cross sectional view about the preferred embodiment of the power beating device of the present invention.
Figure 5:
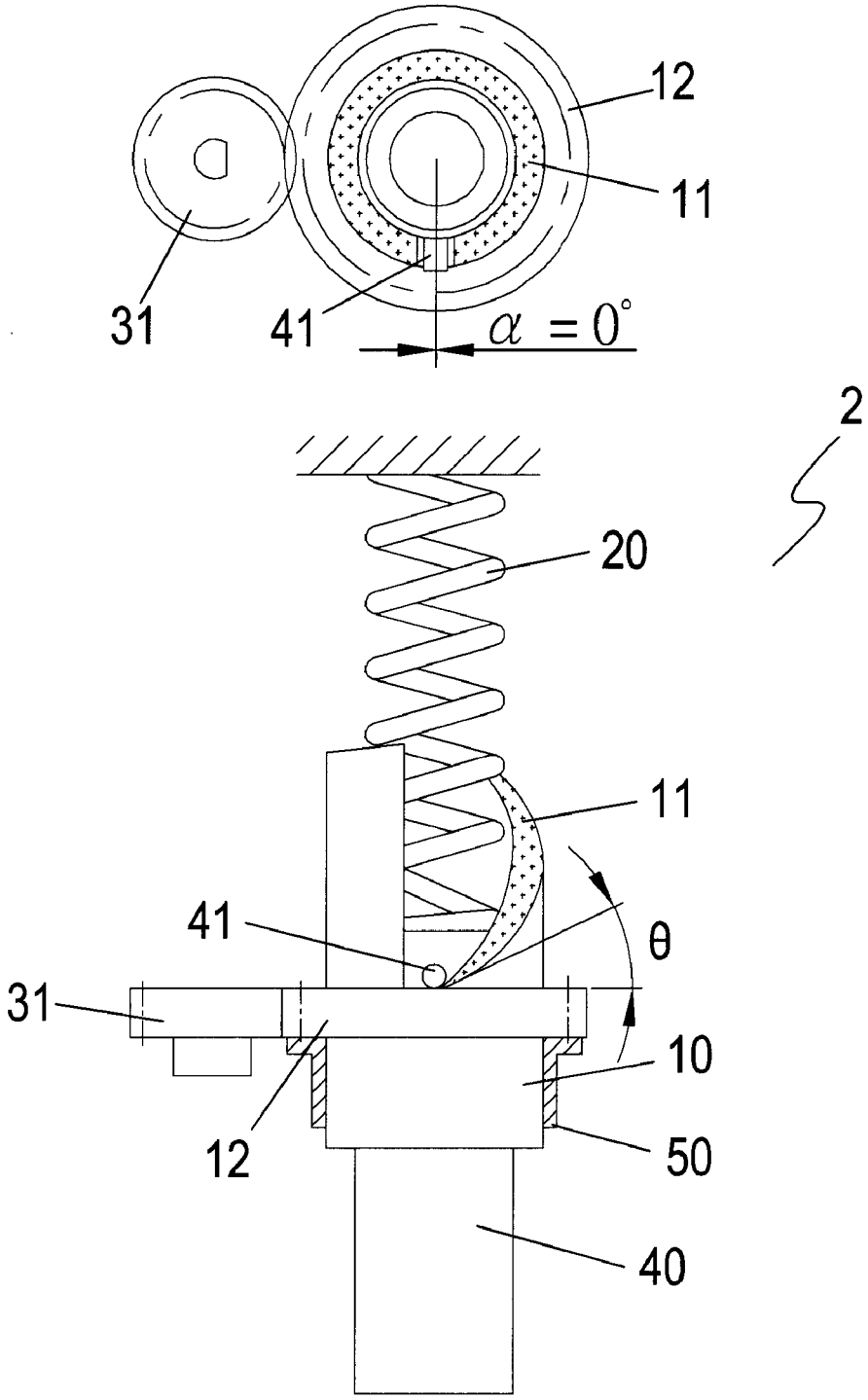
FIG. 5 is a schematic view showing the operation of the present invention.
Figure 6:
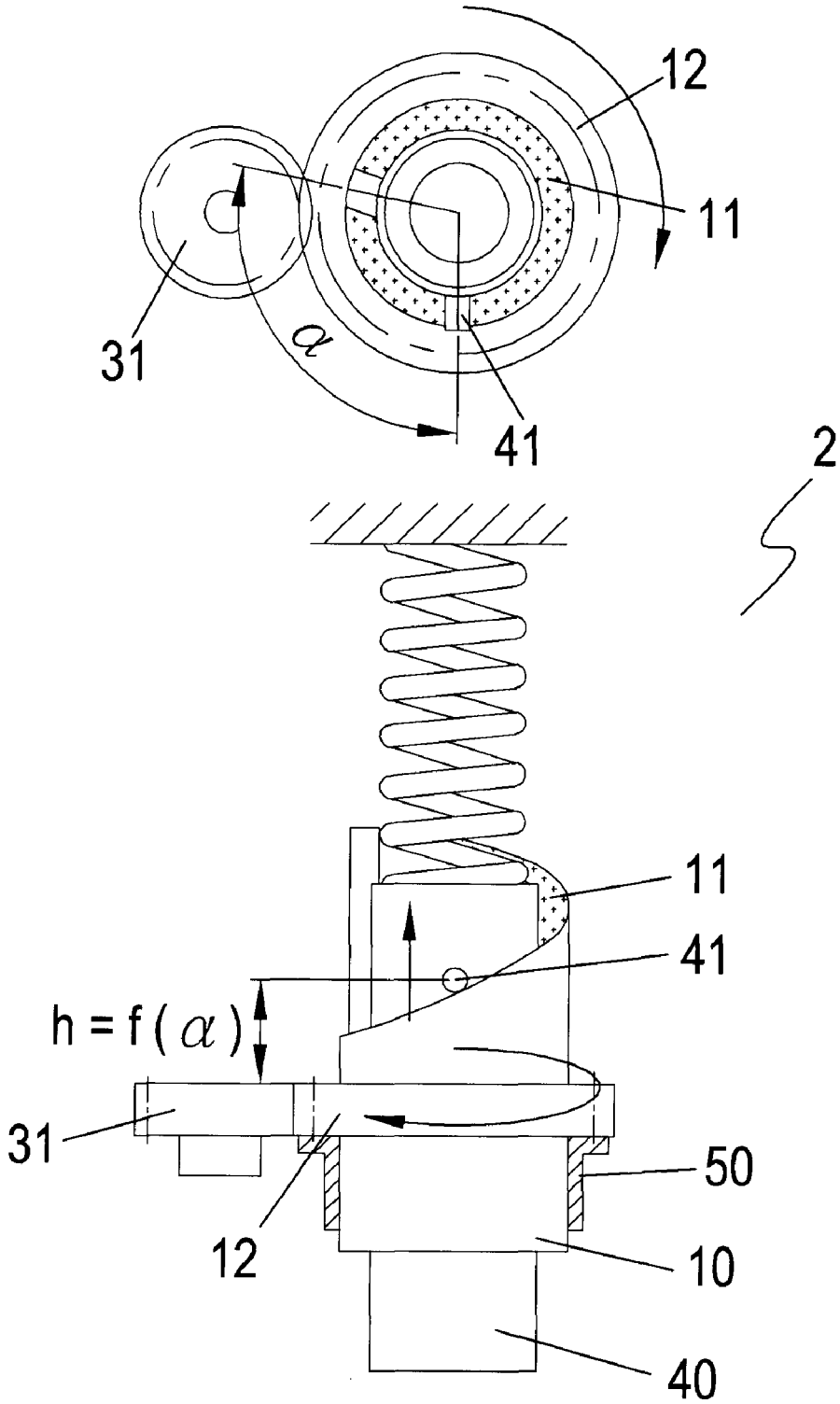
FIG. 6 is another schematic view showing the operation of the present invention.
Figure 7:
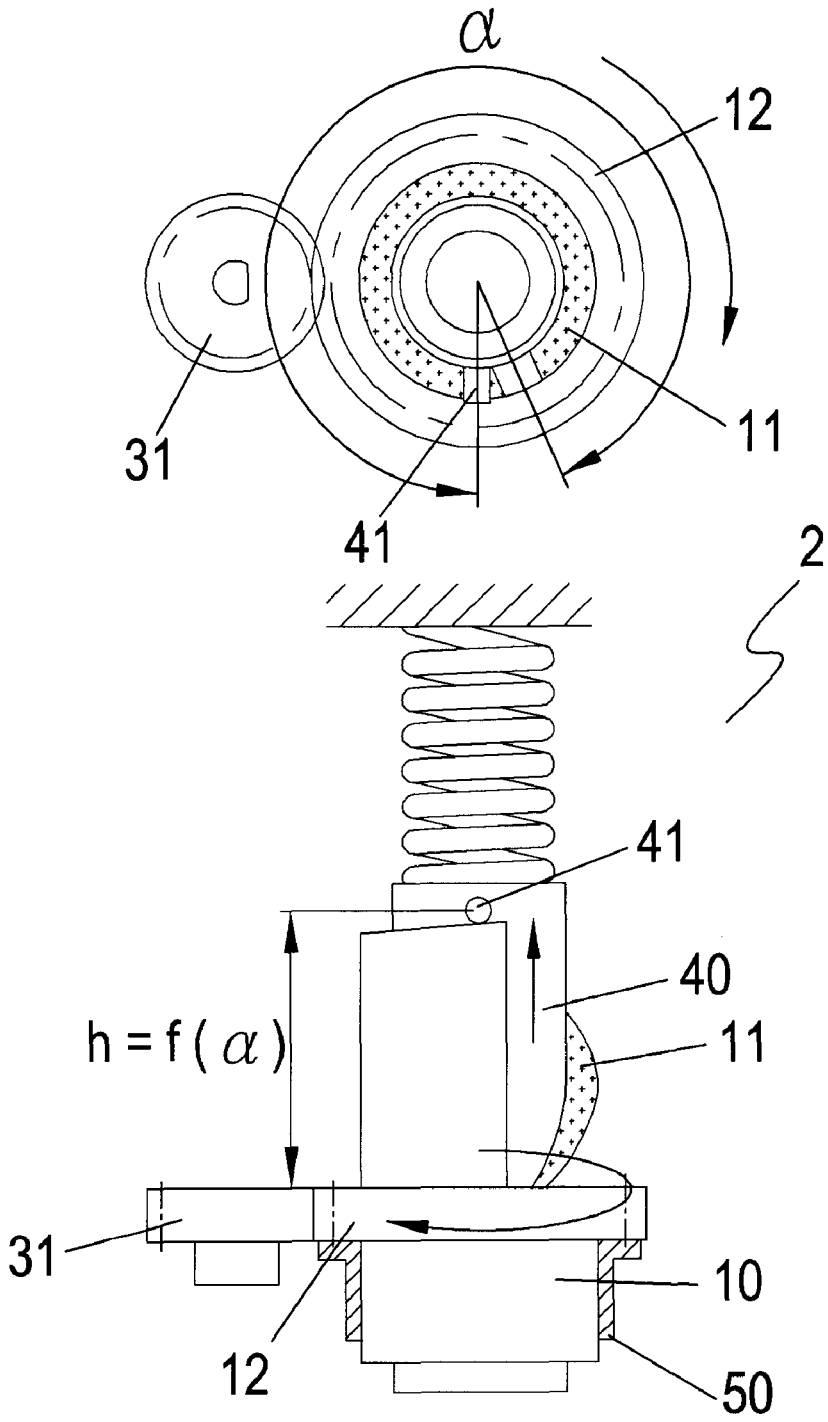
FIG. 7 is a further schematic view about the operation of the present invention.

Referring to FIGS. 3 and 4, it is illustrated that an actuator 30 is formed aside the driving unit 2. The actuator 30 is one of a motor, a liquid pressure motor, a pneumatic motor, an engine, or is driven manually. An outer shaft of the actuator 30 is installed with a transfer gear 31. The transfer gear 31 is engaged to the driven gear 12 of the driving rotary cylinder 10. As the transfer gear 31 rotates, the driven gear 12 will be driven to rotate along the driving bush 50. At the same moment, the driving pin 41 will be driven so as to further drive the impact unit 40 to compress the spring 20 to store potential energy.

Referring to FIGS. 3, 5, 6 and 7, it is illustrated when the rotation angle $\alpha$ of the driving rotary cylinder 10 is 0 degree, the height of the driving pin 41 is reset. When the height of the driven gear 12 is increased, the rotation angle is also increased and thus the driving pin 41 moves higher and higher. When the rotation angle $\alpha$ is 360 degrees, the driving pin 41 moves to the top, that is to say, when the rotation angle $\alpha$ is over 360 degrees, the height is reset.

When the driving unit 2 moves, the impact unit 40 will move higher with the driving surface 11 of the driving unit 2 and the spring 20 compresses for storing energy. When the impact unit 40 is lifted to a predetermined height, the rotation angle $\alpha$ of the driven gear 12 increases to be over 360 degrees, it will reset so that the spring 20 will release potential energy to be converted into dynamic energy. When the impact unit 40 is driven, the structure generates a beating due to power.

To further, the present invention is installed with a driving rotary cylinder 10 which is driven by the actuator 30. The driving rotary cylinder 10 is installed with an axial driving surface 11. The rotation of the driving rotary cylinder 10 will drive the impact unit 40 to move upwards and downwards. The height of the driving surface 11 is increased linearly. The height $h=f(\alpha)$, where $\alpha$ is between 0 to 360 degrees. f( ) is a function.

Figure 8:
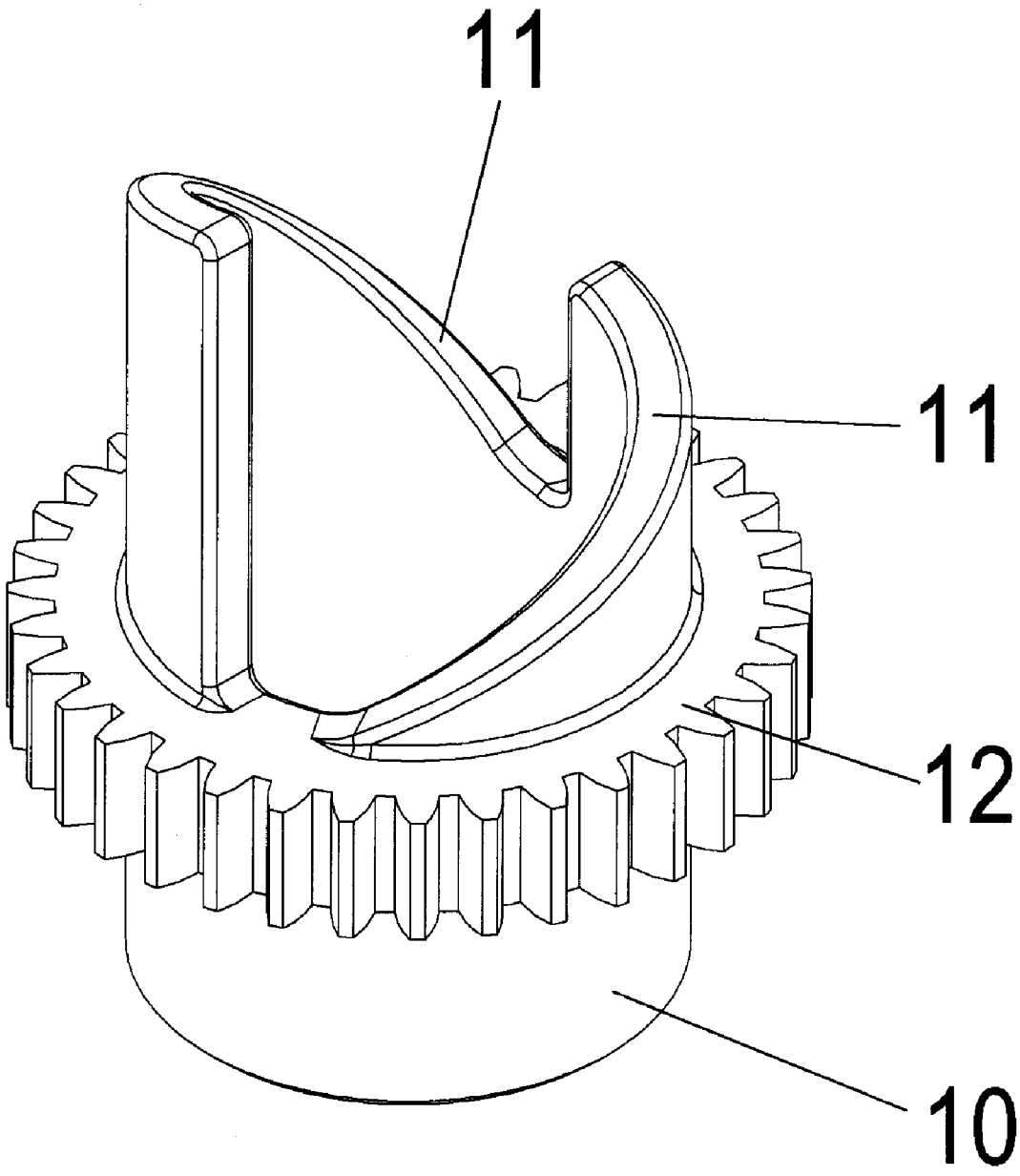
FIG. 8 is a schematic view showing another driving rotary cylinder according to the power beating device of the present invention.

Referring to FIG. 8, the application of the present invention will be described herein. The driving rotary cylinder 10 has a plurality of driving surfaces 11. The axial driving surface 11 of the driving rotary cylinder 10 has a height which is increased in rotation direction, where $h=A\alpha+B$, when the $\alpha$ is between 0 and 360 degrees, in that A and B are constant value, in the formula, B is zero and $A=\tan(\alpha)*H$, in that H is a maximum spring displacement value, as $\alpha=0$, $h=0$.

Figure 9:
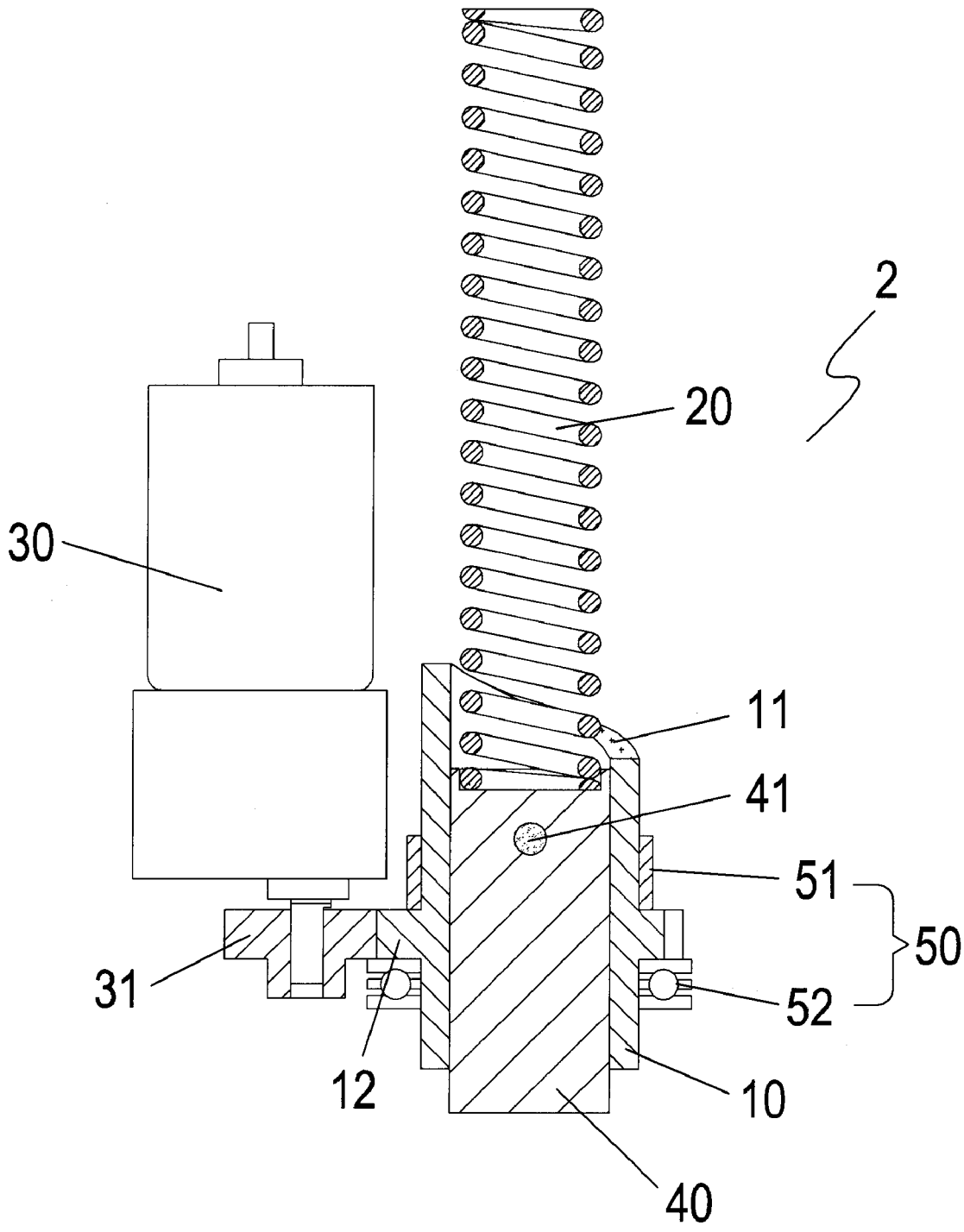
FIG. 9 is a cross sectional view about the power beating device of the present invention.

With reference to FIG. 9, it is illustrated that the driving bush 50 contains a liner 51 enclosing the driving rotary cylinder 10 at an upper side of the driven gear 12 and a bearing 52 below the driving rotary cylinder 10.

Advantages of the present invention will be described herein. In the driving unit, the spring unit is used for storing and releasing energy for driving an impact unit so that the electric power efficiency is higher and the weight is light. It is especially advantageously to be used in handset. The driving unit of the present invention uses a spring to store energy which is suitable for outputting power with a battery so as to reduce the current of the battery and has a higher output efficiency.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A power beating device using the inclined plane principle comprising:

a spring (20) for storing and releasing energy, an impact unit (40) driven by the spring (20) being a round cylinder with a hole at a lateral side thereof;

a driving rotary cylinder (10) having a hollow center for receiving the impact unit (40); an upper edge of the driving rotary cylinder (10) being formed as at least one wedge helical driving surface (11);

a driving pin (41) inserting into the hole at a lateral side of the impact unit (40); a lower side of the spring (20) resisting against the driving pin (41); and in assembly state, the driving pin (41) being located at an upper side of the wedge helical driving surface (11);

a driven gear (12) at an outer periphery of the driving rotary cylinder (10) below the wedge helical driving surface (11); the driven gear (12) being driven to rotate in a driving bush (50);

a driving bush (50) installed at a lower side of the driving rotary cylinder (10); the driving bush (50) having a hollow center for receiving a lower end of the driving rotary cylinder (10); an upper end of the driving bush (50) having a flange extending therefrom;

an actuator (30) formed aside a driving unit (2); and a transfer gear (31) installed with an outer shaft of the actuator (30);

the transfer gear (31) being engaged to the driven gear (12) of the driving rotary cylinder (10); and wherein as the transfer gear (31) rotates, the driven gear (12) will be driven to rotate along the driving bush (50); at the same moment, the driving pin (41) will be driven so as to further drive the impact unit (40) to compress the spring (20) to store potential energy; and wherein an upper edge of the driving rotary cylinder (10) is formed with at least two wedge helical driving surfaces (11).

2. The power beating device as claimed in claim 1, wherein the actuator is one of a motor, a liquid pressure cylinder, a pneumatic cylinder, a liquid pressure motor, a pneumatic motor, an engine and manual power.

* * * * *